US010873127B2

(12) United States Patent
Choi

(10) Patent No.: US 10,873,127 B2
(45) Date of Patent: Dec. 22, 2020

(54) VEHICULAR ANTENNA

(71) Applicant: LS MTRON LTD., Anyang-si (KR)

(72) Inventor: Seung-Ho Choi, Seoul (KR)

(73) Assignee: LS MTRON LTD., Anyang-si (KR)

( * ) Notice: Subject to any disclaimer, the term of this patent is extended or adjusted under 35 U.S.C. 154(b) by 106 days.

(21) Appl. No.: 16/311,074

(22) PCT Filed: Oct. 25, 2016

(86) PCT No.: PCT/KR2016/012014
§ 371 (c)(1),
(2) Date: Dec. 18, 2018

(87) PCT Pub. No.: WO2017/222114
PCT Pub. Date: Dec. 28, 2017

(65) Prior Publication Data

US 2019/0393590 A1 Dec. 26, 2019

(30) Foreign Application Priority Data

Jun. 20, 2016 (KR) ..... 10-2016-0076709

(51) Int. Cl.

| | |
|---|---|
| ***H01Q 1/32*** | (2006.01) |
| ***H01Q 1/48*** | (2006.01) |
| ***H01Q 9/04*** | (2006.01) |
| ***H01Q 19/10*** | (2006.01) |

(52) U.S. Cl.
CPC ..... *H01Q 1/3208* (2013.01); *H01Q 1/48* (2013.01); *H01Q 9/0428* (2013.01); *H01Q 19/10* (2013.01)

(58) Field of Classification Search
CPC ..... H01Q 1/32; H01Q 1/3208; H01Q 1/3225; H01Q 1/3275; H01Q 1/48; H01Q 9/0428; H01Q 19/10; H01Q 1/325
See application file for complete search history.

(56) References Cited

U.S. PATENT DOCUMENTS 5,563,616 A * 10/1996 Dempsey ..... H01Q 1/38 343/700 MS
5,926,136 A * 7/1999 Ohtsuka ..... H01Q 3/02 343/700 MS
8,106,850 B1 1/2012 Gregoire et al.
(Continued)

FOREIGN PATENT DOCUMENTS

CN 202013942 U 10/2011
CN 102255142 A 11/2011
(Continued)

OTHER PUBLICATIONS

International Search Report for related International Application No. PCT/KR2016/012014; report dated Dec. 28, 2017; (2 Pages).
(Continued)

*Primary Examiner* — Hoang V Nguyen
(74) *Attorney, Agent, or Firm* — K&L Gates LLP

(57) ABSTRACT

Disclosed is a vehicular antenna, which includes an antenna module having an antenna patch, a reflector installed to be spaced apart from the antenna patch by a predetermined distance to maximize a gain of an electromagnetic wave radiated from the antenna patch at a specific angle, and a dielectric substance inserted and installed between the antenna patch and the reflector.

10 Claims, 9 Drawing Sheets

(56) References Cited

U.S. PATENT DOCUMENTS

| | | | |
|---|---|---|---|
| 8,421,693 | B2 | 4/2013 | Ohshima et al. |
| 8,754,819 | B2 | 6/2014 | Li et al. |
| 9,509,058 | B2 | 11/2016 | Matsumura et al. |
| 9,966,669 | B2 | 5/2018 | Dobric et al. |
| 2004/0061648 | A1 | 4/2004 | Pros et al. |
| 2007/0229359 | A1 | 10/2007 | Heyde |
| 2008/0068268 | A1 | 3/2008 | Kowalewicz et al. |
| 2008/0316140 | A1 | 12/2008 | Wu et al. |

FOREIGN PATENT DOCUMENTS

| | | | |
|---|---|---|---|
| CN | 104638378 | A | 5/2015 |
| JP | 2944505 | B5 | 9/1999 |
| JP | 2003163526 | A | 6/2003 |
| JP | 2003283239 | A | 10/2003 |
| JP | 2009135741 | | 6/2009 |
| JP | 2013522962 | | 6/2013 |
| JP | 2015502723 | | 1/2015 |
| JP | 2016001791 | A | 1/2016 |
| JP | 201618795 | | 2/2016 |
| KR | 100145922 | B1 | 8/1998 |
| KR | 1020050034860 | A | 4/2005 |
| KR | 100924126 | B1 | 10/2009 |
| KR | 1020100110052 | A | 12/2010 |
| KR | 101342011 | B1 | 12/2013 |
| WO | 2003041222 | A1 | 3/2005 |

OTHER PUBLICATIONS

Written Opinion for related International Application No. PCT/KR2016/012014; report dated Dec. 28, 2017; (5 Pages).

* cited by examiner (a)

(b)

VEHICULAR ANTENNA

CROSS-REFERENCE TO RELATED APPLICATIONS

The present application is a National Stage of International Application No. PCT/KR2016/012014 filed Oct. 25, 2016, which claims priority to Korean Patent Application No. 10-2016-0076709 filed on Jun. 20, 2016 in the Republic of Korea, the disclosures of which are incorporated herein by reference.

TECHNICAL FIELD

The present application claims priority to Korean Patent Application No. 10-2016-0076709 filed on Jun. 20, 2016 in the Republic of Korea, the disclosures of which are incorporated herein by reference.

The present disclosure relates to an antenna technology, and more particularly, to a vehicular antenna, which has a reduced size.

BACKGROUND ART

As communication devices have developed, an antenna for transmitting and receiving various types of radio signals is installed inside or outside a vehicle. Various types of radio signals may include Global Navigation Satellite System (GNSS) signals for utilizing a location based system, FM and AM radio signals, Digital Multimedia Broadcast (DMB) signals for watching digital broadcasting in a vehicle, Telematics Management Unit (TMU) signals for telematics communication, XM satellite radio signals, Sirius signals, Digital Audio Broadcasting (DAB) signals, and the like. An important issue in the field of vehicular antenna is to miniaturize the antenna due to space restriction of the vehicle.

Recently, the demand for a vehicle antenna for satellite multimedia service (Sirius XM) for North America is increasing. Currently, only voice services are available, but its importance will become more increasing if it is extended to data services. A vehicular antenna to receive the satellite multimedia service should include a 2.4 GHz Right Hand Circular Polarized (RHCP) antenna patch and a reflector serving as a conductor structure installed at a certain interval from the antenna patch, as basic components. The spacing distance between the reflector and the antenna patch is adjusted to meet the performance specifications of the satellite multimedia service.

FIG. 1 is a diagram showing a conventional vehicular antenna. As shown in FIG. 1, a conventional vehicular antenna includes a base 110, a signal processing board 120, an antenna module 130, a reflector 140 and a housing 150.

The base 110 is a member having a plate shape as a whole, and includes a lower surface coupled to an outer panel of a vehicle. Also, the signal processing board 120 and the antenna module 130 are installed at an upper portion of the base 110.

The signal processing board 120 processes signals received through the antenna module 130. For example, the signal processing board 120 filters a signal of a desired frequency band by using a band pass filter to remove noise and amplifies the filtered signal to a required level. The signal processing board 120 may be provided in the form of, for example, a printed circuit board (PCB).

The antenna module 130 receives a signal for the satellite multimedia service described above and transmits the signal to the signal processing board 120. The antenna module 130 is installed on the ground surface of the signal processing board 120, and a dielectric substance 132 and an antenna patch 133 are laminated in order in the antenna module 130.

The reflector 140 is fixedly installed at the housing 150 or another support structure to be spaced apart from an upper portion of the antenna module 130 by a certain distance. Since the reflector 140 is located at a certain distance from the antenna module 130, the reflector 140 plays a role of tilting the electromagnetic wave radiated from the antenna module 130 to maximize the gain at a certain angle. Generally, for the North American satellite multimedia service, the peak gain of the electromagnetic wave should appear at about 60 degrees based on the center of the antenna module 130, and for this, the antenna module 130 and the reflector 140 should be separated by at least 3 mm to 10 mm.

The housing 150 is coupled to the base 110 and accommodates the signal processing board 120, the antenna module 130 and the reflector 140 in an accommodation space therein. The housing 150 may have a shark fin shape to reduce air resistance and wind noise generated while the vehicle is moving.

As described above with reference to FIG. 1, the vehicular antenna for the North American satellite multimedia service should include the 2.4 GHz RHCP antenna patch 133 and the reflector 140, which is a conductor structure installed at a regular interval from the antenna patch 133, as a basic configuration, and the antenna patch 133 and the reflector 144 should be spaced apart by at least 3 mm to 10 mm in order to obtain the peak gain of the electromagnetic wave at 60 degrees. For this reason, the vehicular antenna inevitably has a great size. Thus, the antenna patch 133 and the reflector 144 having at least a spacing distance occupies much space in the streamlined vehicular antenna. In addition, when the vehicular antenna is implemented by simultaneously using various kinds of antenna modules, for example an antenna module for mobile communication service such as LTE (Long Term Evolution) and an antenna module for GNSS service, the wide spacing between the antenna patch 133 and the reflector 144 becomes a limit in space utilization.

DISCLOSURE

Technical Problem

The present disclosure is designed to solve the problems of the related art, and therefore the present disclosure is directed to providing a vehicular antenna for satellite multimedia service, which may be miniaturized by reducing an interval between an antenna patch and a reflector.

In addition, the present disclosure is also directed to providing a vehicular antenna, which may enhance the radiation efficiency while reducing the interval between the antenna patch and the reflector.

Technical Solution

In one aspect of the present disclosure, there is provided a vehicular antenna, comprising: an antenna module having an antenna patch; a reflector installed to be spaced apart from the antenna patch by a predetermined distance to maximize a gain of an electromagnetic wave radiated from the antenna patch at a specific angle; and a dielectric substance inserted and installed between the antenna patch and the reflector.

According to an embodiment, the dielectric substance may be installed in contact with the reflector and spaced apart from the antenna patch by a predetermined distance.

According to an embodiment, the vehicular antenna may further comprise a spacer installed in a space between the antenna patch and the dielectric substance to be in contact with the antenna patch and the dielectric substance.

According to an embodiment, the spacer may be a substance with a low dielectric permittivity such as a sponge.

According to an embodiment, the dielectric substance may have a dielectric permittivity of 3 to 50.

According to an embodiment, the antenna module may include a ground surface; a dielectric substance laminated on the ground surface; and the antenna patch laminated on the dielectric substance.

According to an embodiment, an upper surface of the reflector may have a fractal structure that includes a lot of edges, and may radiate an electric field through the edges.

According to an embodiment, the dielectric substance and the reflector may have a size identical to or greater than the antenna patch.

According to an embodiment, the dielectric substance may have a greater thickness than the reflector.

Advantageous Effects

According to the embodiment, since a dielectric substance is inserted between the antenna patch and the reflector, the vehicular antenna for satellite multimedia service may be miniaturized by reducing the physical spacing distance between the antenna patch and the reflector while satisfying the satellite multimedia service standards.

According to an embodiment, since the upper surface of the reflector is made to have a fractal structure with a lot of edges, it is possible to compensate for the radiation loss caused by the dielectric substance.

According to an embodiment, since a spacer with a low dielectric permittivity is inserted into the space between the antenna patch and the dielectric substance, it is possible to fabricate the antenna patch, the dielectric substance and the reflector into an integrated form, thereby simplifying the manufacturing process of the vehicular antenna and thus lowering the defective proportion. In addition, it is possible to reduce the occurrence of faults in the a vehicular antenna by absorbing the impact generated while the vehicle is moving.

BEST MODE

Figure 1:
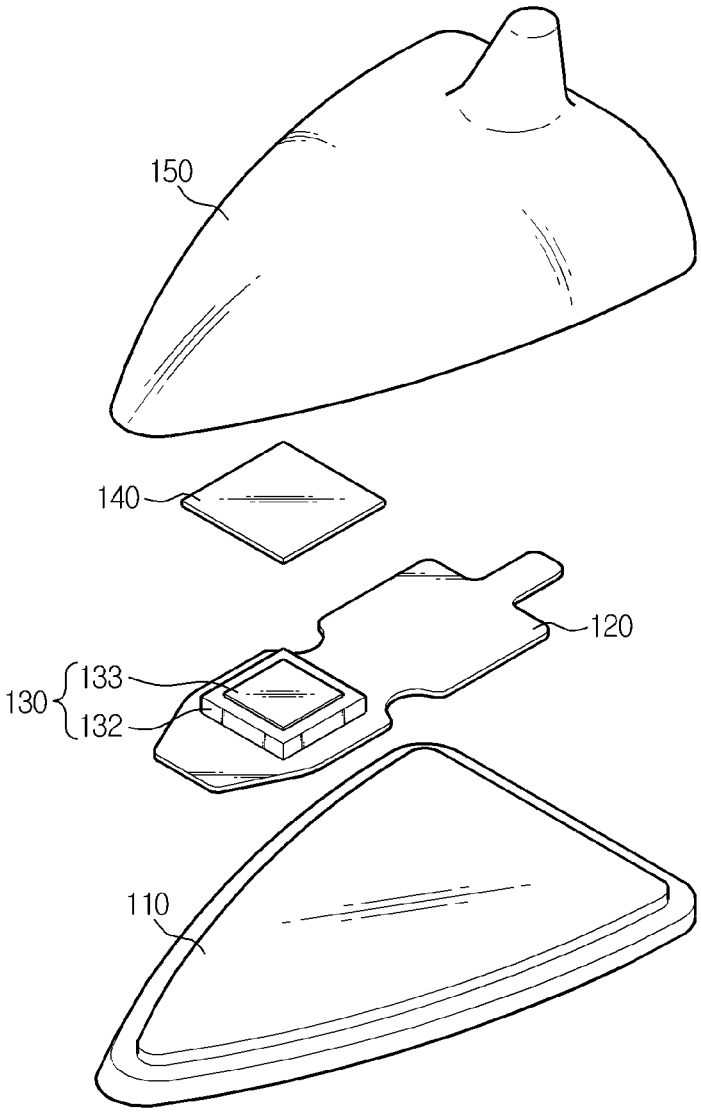
FIG. 1 is a diagram showing a conventional vehicular antenna.

Hereinafter, preferred embodiments will be described in detail with reference to the accompanying drawings so that the present disclosure may be easily implemented by those skilled in the art. However, in the following detailed description of the preferred embodiments of the present disclosure, detailed description of known functions or configurations will be omitted when the subject matter of the present disclosure may be unnecessarily obscure thereby. Similar reference numerals are used throughout the drawings for components having similar functions and operations.

Figure 2:
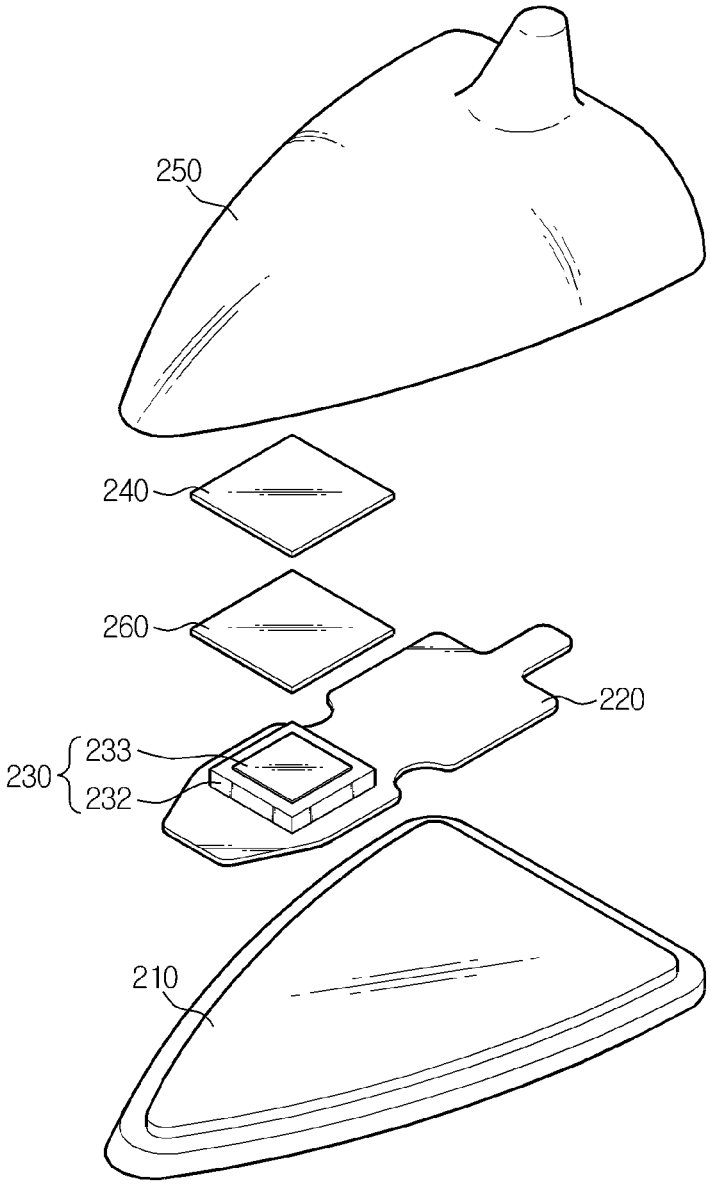
FIG. 2 is a diagram showing a vehicular antenna according to an embodiment of the present disclosure.

FIG. 2 is a diagram showing a vehicular antenna according to an embodiment of the present disclosure. As shown in FIG. 2, the vehicular antenna according to this embodiment includes a base 210, a signal processing board 220, an antenna module 230, a reflector 240, a housing 250 and a dielectric substance 260.

The base 210 is a member having a plate shape as a whole, and includes a lower surface coupled to an outer panel of a vehicle. Also, the signal processing board 220 and the antenna module 230 are installed at an upper portion of the base 210.

The signal processing board 220 processes signals received through the antenna module 230. For example, the signal processing board 220 filters a signal of a desired frequency band by using a band pass filter to remove noise and amplifies the filtered signal to a required level. The signal processing board 220 may be provided in the form of, for example, a printed circuit board (PCB).

The antenna module 230 receives a signal for satellite multimedia service and transmits the signal to the signal processing board 220. The antenna module 230 is installed on the ground surface of the signal processing board 220, and a dielectric substance 232 and an antenna patch 233 are laminated in order in the antenna module 230. The antenna patch 233 is a 2.4 GHz Right Hand Circular Polarized (RHCP) patch. The reflector 240 is a conductor with a plate shape, and the reflector 240 fixedly installed at the housing 250 or another support structure to be spaced apart from an upper portion of the antenna module 230 by a certain distance. Since the reflector 240 is located at a certain distance from the antenna module 230, the reflector 240 tilts the electromagnetic wave radiated from the antenna module 230 to maximize the gain at a certain angle. Generally, for the North American satellite multimedia service, the peak gain of the electromagnetic wave should appear at about 60 degrees based on the center of the antenna module 230. Here, the spacing between the reflector 240 and the antenna patch 233 is adjusted so that the peak gain of the electromagnetic wave appears at about 60 degrees based on the center of the antenna module 230.

Compared to the conventional vehicular antenna, the vehicular antenna according to this embodiment further includes a dielectric substance 260 between the antenna patch 233 of the antenna module 230 and the reflector 240. The dielectric substance 260 is installed to be in contact with a lower surface of the reflector 240 and spaced apart from the antenna patch 233 by a predetermined distance, for example at least 0.1 mm. If the dielectric substance 260 is installed in physical contact with the antenna patch 233, the impedance is affected, so the size of the antenna patch 233 should be reduced for impedance matching, which however reduces the radiation efficiency. Thus, in order to maintain the radiation efficiency, it is desirable that the antenna patch 233 and the dielectric substance 260 are spaced by at least 0.1 mm. If the antenna patch 233 and the dielectric substance 260 are spaced by at least 0.1 mm, an air gap having a dielectric permittivity close to 1 is formed between the antenna patch 233 and the dielectric substance 260, thereby minimizing the influence on impedance.

The dielectric substance 260 preferably has a dielectric permittivity of 3 to 50, and for example, the dielectric substance 260 of this embodiment has a dielectric permittivity of 12. In the conventional vehicular antenna as depicted in FIG. 1, an air gap is formed between the antenna patch 133 and the reflector 140 without any object being placed therein. However, in the vehicular antenna according to this embodiment, the dielectric substance 260 is further provided between the antenna patch 233 and the reflector 240, and the reflector 240 may be located closer to the antenna patch 233 due to the dielectric substance 260. In other words, the reflector 240 may be located with a smaller spacing distance, compared to the spacing distance between the antenna patch 133 and the reflector 140 of the conventional antenna.

The housing 250 is coupled to the base 210 and accommodates the signal processing board 220, the antenna module 230 and the reflector 240 in an accommodation space therein. The housing 250 may have a shark fin shape to reduce air resistance and wind noise generated while the vehicle is moving.

Figure 3:
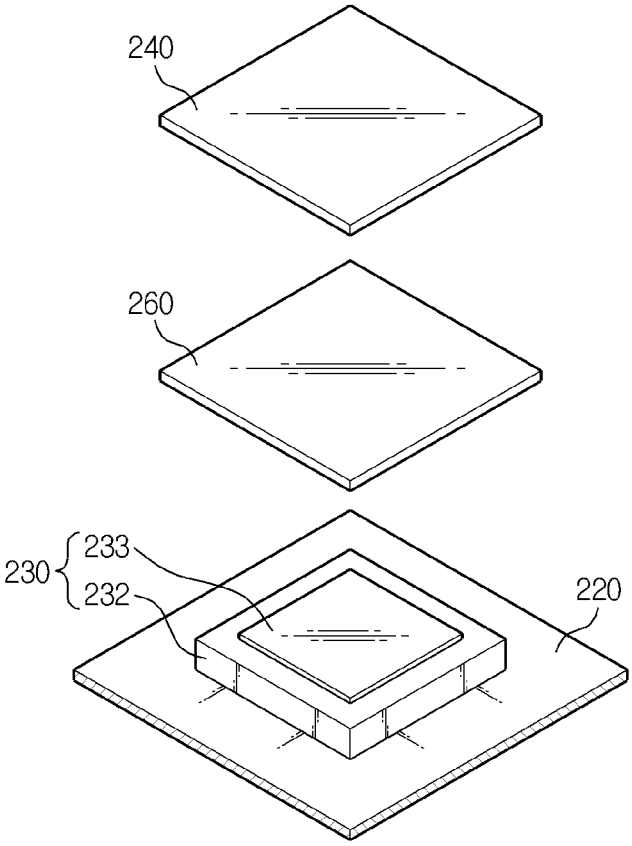
FIG. 3 is a perspective view showing main components of the vehicular antenna, depicted in FIG. 2.
Figure 4:
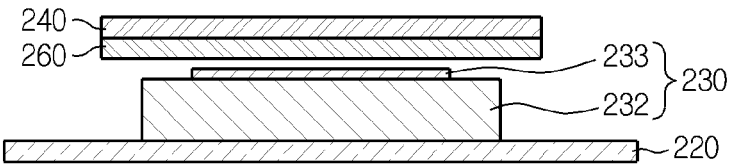
FIG. 4 is a cross-sectioned view showing that the main components of FIG. 3 are laminated.

FIG. 3 is a perspective view showing main components of the vehicular antenna, depicted in FIG. 2, and FIG. 4 is a cross-sectioned view showing that the main components of FIG. 3 are laminated.

Referring to FIGS. 3 and 4, the dielectric substance 232 and the antenna patch 233 of the antenna module 230 are laminated on the ground surface of the signal processing board 220 in order. The antenna module 230 is configured identical to a general micro-strip patch antenna. The antenna module 230 receives a 2.4 GHz satellite multimedia service signal as described above. A feeding member is installed at the ground surface of the signal processing board 220, and the feeding member is connected to the antenna patch 233 through a feeding line. The feeding member and the feeding line are generally made of conductive lines or the like. The dielectric substance 232 included in the antenna module 230 is installed between the ground surface and the antenna patch 233, and the dielectric substance 232 may employ various materials such as plastic, Teflon, ceramic, glass, epoxy, synthetic resin and the like. The antenna patch 233 is formed using a metal sheet with excellent electrical conductivity. For example, the antenna patch 233 may use a thin plate of metal such as copper or aluminum, or a thin plate of metal such as silver and gold which has excellent electrical conductivity and ensures excellent shaping and working.

As shown in FIGS. 3 and 4, the dielectric substance 260 is inserted between the antenna module 230 and the reflector 240. The dielectric substance 260 may employ various dielectric materials such as plastics, Teflon, ceramics, glass, epoxy, and synthetic resin. The dielectric substance 260 is in surface contact with the reflector 240 and is spaced apart from the antenna patch 230 of the antenna module 230 by a predetermined spacing distance. The dielectric substance 260 and the antenna patch 233 is spaced by at least 0.1 mm to form an air gap. If the dielectric substance 260 and the antenna patch 233 are physically contacted with each other, impedance will be affected thereby, and the size of the antenna patch 233 must be reduced to achieve impedance matching, which reduces the radiation efficiency. Thus, in order to maintain the radiation efficiency, it is desirable that the antenna patch 233 and the dielectric substance 260 are separated by at least 0.1 mm. If the antenna patch 233 and the dielectric substance 260 are separated by at least 0.1 mm, the air gap with a dielectric permittivity close to 1 is formed between the antenna patch 233 and the dielectric substance 260, thereby minimizing the influence on impedance.

Since the dielectric substance 260 is installed in contact with the reflector 240 and the antenna patch 233 and the dielectric substance 260 are spaced apart from each other by a predetermined distance, the reflector 240 is fixed to the housing 250 or a separate supporting structure. If the dielectric substance 260 is inserted between the antenna patch 233 and the reflector 240, an electrical signal delay effect is caused due to the dielectric permittivity of the dielectric substance 260, thereby achieving the same effect as increasing the physical spacing distance between the antenna patch 233 and the reflector 240 even though the physical spacing distance is actually reduced. In other words, it is possible to obtain the same radiation effect as conventional while the spacing distance between the antenna patch 233 and the reflector 240 is minimized.

The thickness of the dielectric substance 260 is greater than the thickness of the reflector 240. In this embodiment, the thickness of the reflector 240 is 0.15 mm and the thickness of the dielectric substance 260 is 0.8 mm. As described above, the dielectric permittivity of the dielectric substance 260 is preferably 3 to 50. If the thickness of the dielectric substance 260 is smaller than the thickness of the reflector 240, the dielectric permittivity of the dielectric substance 260 becomes greater than 50, resulting in radiation loss. Thus, the thickness of the dielectric substance 260 should be smaller than the thickness of the reflector 240.

Figure 5:
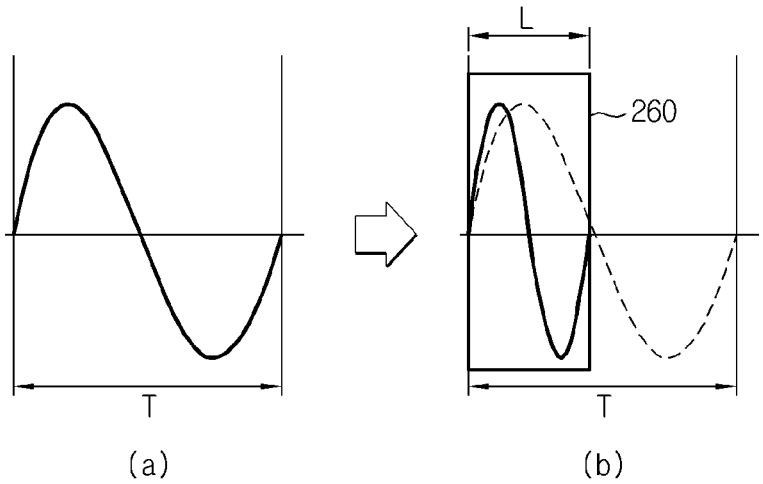
FIG. 5 is a diagram for illustrating the spacing distance reducing effect by a dielectric substance between an antenna patch and a reflector according to an embodiment of the present disclosure.

FIG. 5 is a diagram for illustrating the spacing distance reducing effect by a dielectric substance between an antenna patch and a reflector according to an embodiment of the present disclosure. Here, a portion (a) of FIG. 5 shows the wavelength of an electromagnetic wave when the air gap is provided without the dielectric substance 260 being inserted between the antenna patch 233 and the reflector 240, and a portion (b) of FIG. 5 shows the wavelength of the electromagnetic wave when the dielectric substance 260 having a thickness of L is inserted between the antenna patch 233 and the reflector 240. As shown in FIG. 5, assuming that the wavelength of an electromagnetic wave is T when the air gap is provided without the dielectric substance 260 being inserted between the antenna patch 233 and the reflector 240, when the dielectric substance 260 is inserted between the antenna patch 233 and the reflector 240, the wavelength of the electromagnetic wave radiated from the antenna patch 233 to the reflector 240 is shortened in the dielectric substance 260 having a high dielectric permittivity, thereby giving the same effect same as increasing the physical spacing distance between the antenna patch 233 and the reflector 240 even though the physical spacing distance is actually reduced.

The dielectric permittivity of the dielectric substance 260 is preferably 3 to 50. If the dielectric permittivity of the dielectric substance 260 is smaller than 3, it is not significantly different from the vacuum state, and so a thick dielectric substance 260 must be used, which has substantially no effectiveness. If the dielectric permittivity of the dielectric substance 260 is greater than 50, the thickness of the dielectric substance 260 may be reduced, but the radiation gain is decreased due to the radiation loss caused by the dielectric substance 260. In addition, the dielectric substance 260 and the reflector 240 preferably have a size identical to or greater than the antenna patch 233.

An upper surface of the reflector 240, namely a surface opposite to the surface on which the dielectric substance 260 is installed, may have a fractal structure so that many edges may be included therein. In the vehicular antenna at which the reflector 240 is installed, electromagnetic waves are mainly radiated at the edges of the reflector 240. An edge is a vertex or segment formed when at least two faces meet. If the upper surface of the reflector 240 has a non-fractal structure, namely a planar structure, edges exists only at four sides of the reflector 240. However, if the upper surface of the reflector 240 has a fractal structure, many edges are formed not only at four sides but also at the upper surface of the reflector 240. In this case, it is possible to induce the surface current of the reflector 240 through the edges, so that multiple resonances may be realized, thereby enhancing the radiation effect. If the dielectric substance 260 is inserted between the antenna patch 233 and the reflector 240, the physical spacing distance between the antenna patch 233 and the reflector 240 may be reduced, but the dielectric substance 260 may cause radiation loss. Here, if the upper surface of the reflector 240 is made with a fractal structure to have a lot of edges, it is possible to compensate for the radiation loss caused by the dielectric substance 260.

Figure 6:
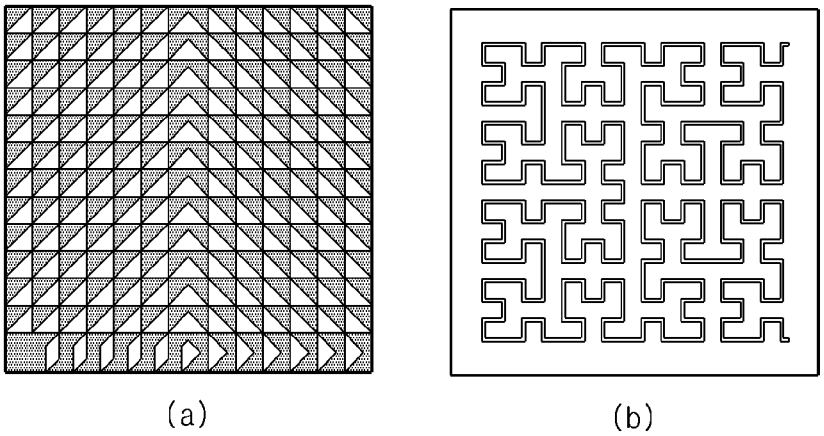
FIG. 6 is a diagram showing a structure of an upper surface of the reflector according to an embodiment of the present disclosure.

FIG. 6 is a diagram showing a structure of an upper surface of the reflector according to an embodiment of the present disclosure. Here, a portion (a) of FIG. 6 shows an example where small triangles are repeatedly filled in the upper surface of the reflector 240, and a portion (b) of FIG. 6 shows an example where the upper surface of the reflector 240 is filled with a Hilbert curve structure. As shown in FIG. 6, since the upper surface of the reflector 240 has a fractal structure to form many edges, an electric field is formed from the edges to the ground surface of the signal processing board 220 to realize multiple resonance, thereby enhancing the radiation efficiency.

Figure 7A:
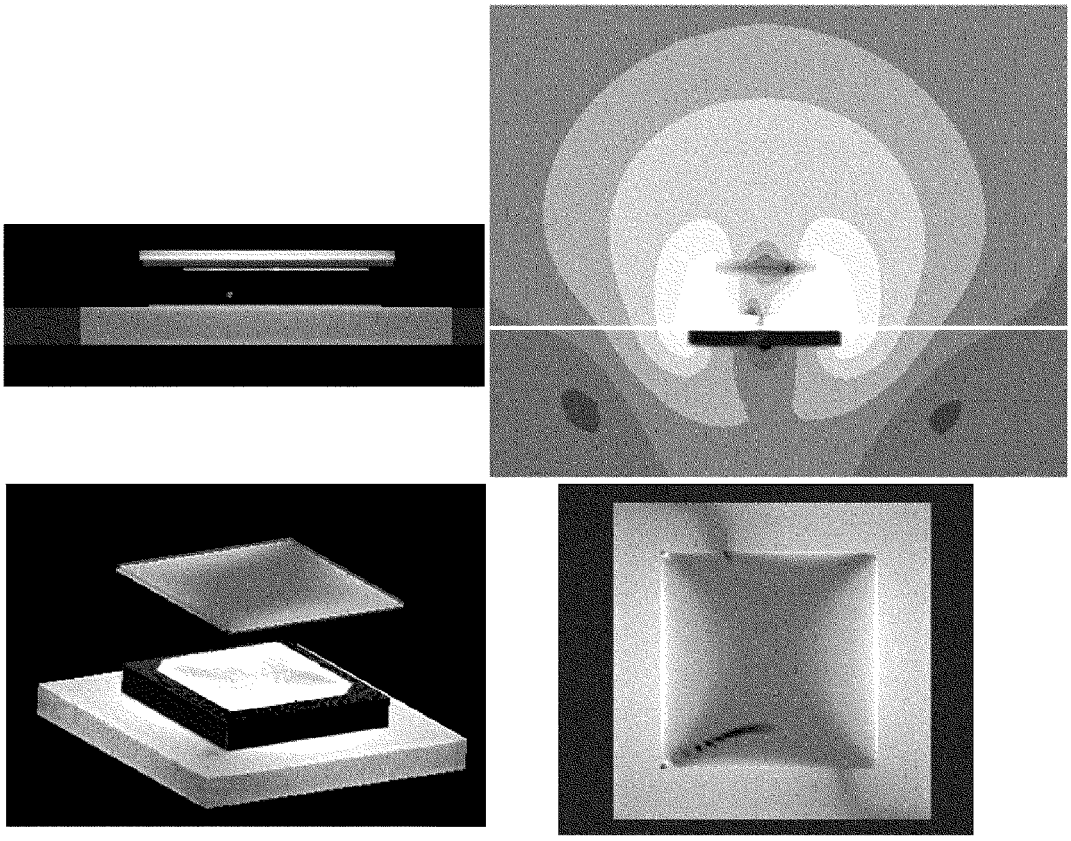
FIG. 7*a* is a diagram showing an electromagnetic field of a conventional vehicular antenna.
Figure 7B:
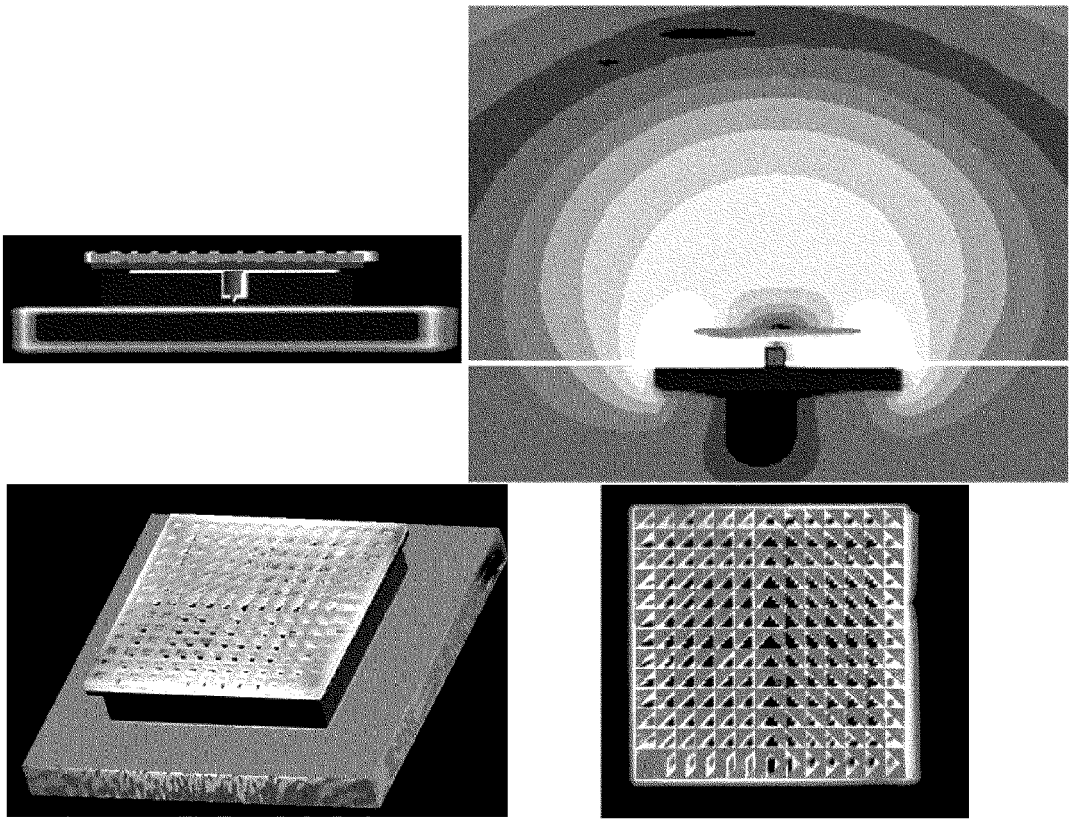
FIG. 7*b* is a diagram showing an electromagnetic field of the vehicular antenna according to an embodiment of the present disclosure.

FIG. 7*a* is a diagram showing an electromagnetic field of a conventional vehicular antenna, and FIG. 7*b* is a diagram showing an electromagnetic field of the vehicular antenna according to an embodiment of the present disclosure. The upper surface of the reflector 140 employed at the conventional vehicular antenna as shown in FIG. 7*a* has a flat structure, namely a non-fractal structure. The upper surface of the reflector 240 employed at the vehicular antenna according to an embodiment of the present disclosure as shown in 7*b* has a fractal structure. As shown in FIGS. 7*a* and 7*b*, the vehicular antenna according to an embodiment of the present disclosure, which has a fractal structure, gives the improved performance at a near field (the yellow color in FIG. 7) formed in the reflector 240 as compared to the conventional non-fractal vehicular antenna, and accordingly the performance of a far field (the red color of FIG. 7) is improved as well, thereby enhancing the radiation efficiency. This is because many edges are formed at the upper surface of the reflector 240 with a fractal structure.

Figure 8:
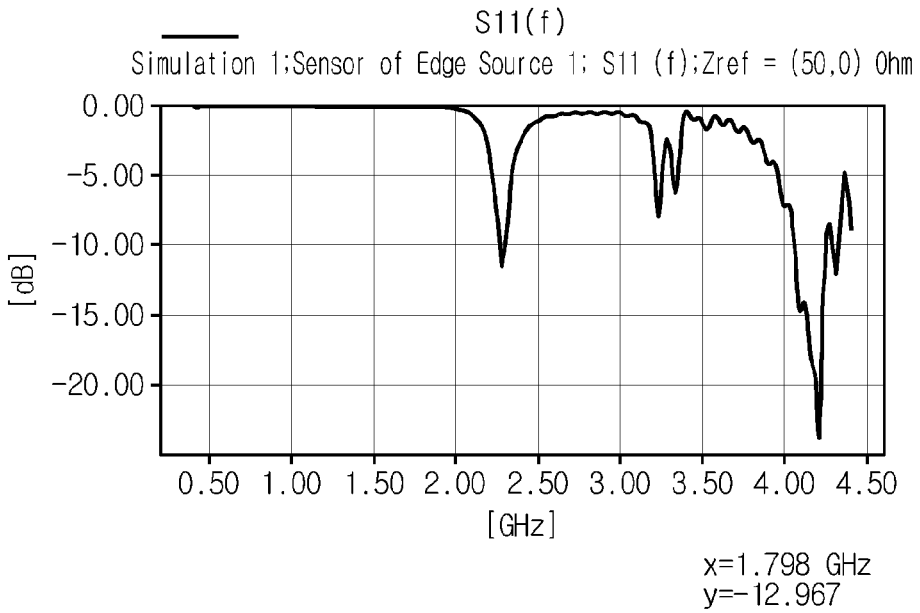
FIG. 8 is a diagram showing a comparison result of voltage standing wave ratios of the conventional vehicular antenna and the vehicular antenna according to an embodiment of the present disclosure.
Figure 8:
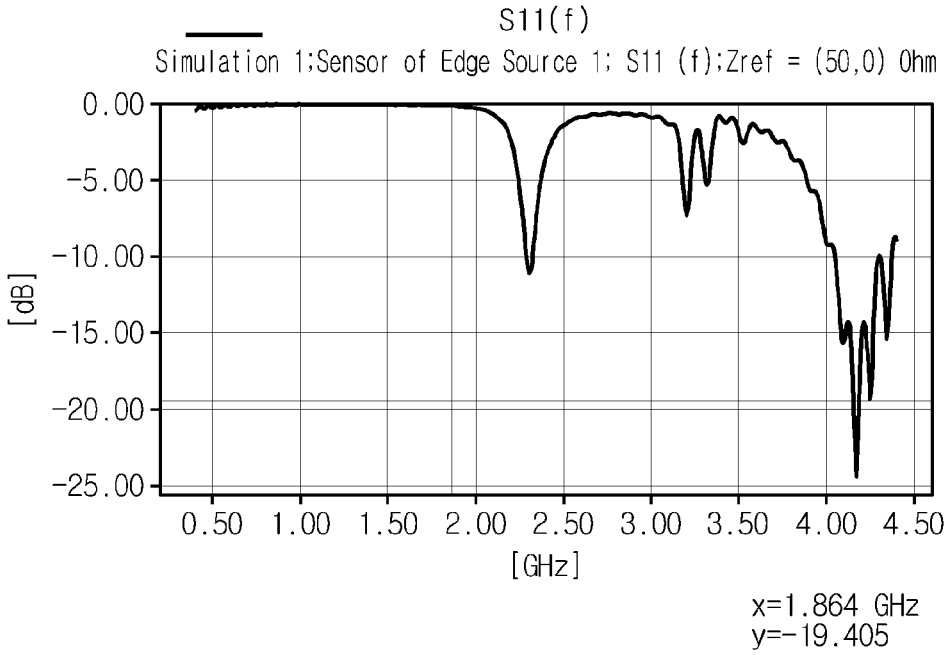
Figure 9:
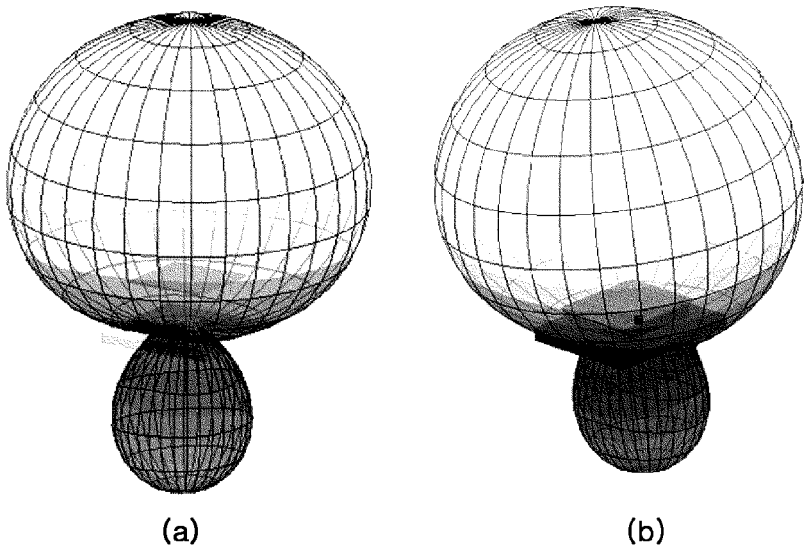
FIG. 9 is a diagram showing radiation patterns of the conventional vehicular antenna and the vehicular antenna according to an embodiment of the present disclosure.

A portion (a) of FIG. 8 is a diagram showing a voltage standing wave ratio (VSWR) of the conventional antenna, and a portion (b) of FIG. 8 is a diagram showing a VSWR of the vehicular antenna according to an embodiment of the present disclosure. A portion (a) of FIG. 9 is a diagram showing a radiation pattern of the conventional antenna, and a portion (b) of FIG. 9 is a diagram showing a radiation pattern of the vehicular antenna according to an embodiment of the present disclosure. As shown in FIGS. 8 and 9, the vehicular antenna according to the present disclosure has the same radiation gain (5.8 dBi) as the conventional vehicular antenna and has similar radiation efficiency and radiation pattern, even though the physical spacing distance is reduced by inserting the dielectric substance 260 between the antenna patch 233 and the reflector 240. The radiation efficiency of the conventional vehicular antenna is 84% and the radiation efficiency of the vehicular antenna according to an embodiment of the present disclosure is 88%. It may be found that the difference is within the simulation error range and thus their radiation efficiencies are equivalent.

Figure 10:
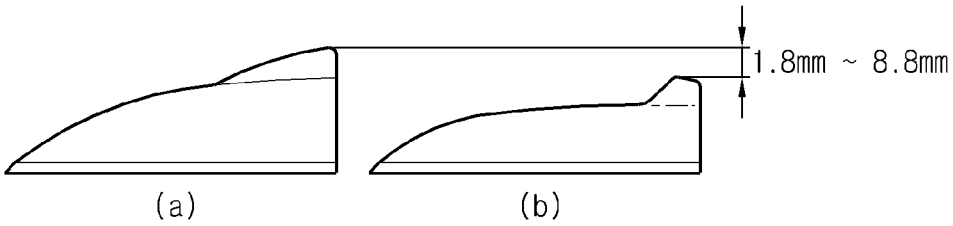
FIG. 10 is a diagram showing a comparison result of heights of the conventional vehicular antenna and the vehicular antenna according to an embodiment of the present disclosure.

FIG. 10 is a diagram showing a comparison result of heights of the conventional vehicular antenna and the vehicular antenna according to an embodiment of the present disclosure. A portion (a) of FIG. 10 shows a conventional vehicular antenna, and a portion (b) of FIG. 10 shows is the vehicular antenna according to an embodiment of the present disclosure. In the conventional vehicular antenna, the spacing distance between the antenna patch 133 and the reflector 140 is 3 mm to 10 mm. However, in the vehicular antenna according to an embodiment of the present disclosure, the dielectric substance 260 with a dielectric permittivity of 12 may be inserted between the antenna patch 233 and the reflector 240 so that the spacing distance between the antenna patch 233 and the reflector 240 becomes 1.2 mm. Thus, as shown in FIG. 10, the vehicular antenna according to an embodiment of the present disclosure may be miniaturized by reducing its height by about 1.8 mm to 8.8 mm compared to the conventional vehicular antenna.

In the above embodiment, the dielectric substance 260 is installed in contact with the reflector 240 but is spaced a certain distance from the antenna patch 233 to maintain the air gap. Thus, the reflector 240 should be fixed to the housing 250 or a separate supporting structure. As another embodiment, the antenna module 230 and the reflector 240 may be integrally formed in a state where a spacer having a dielectric permittivity close to 1, such as a sponge, is inserted between the antenna patch 233 and the dielectric substance 260.

Figure 11:
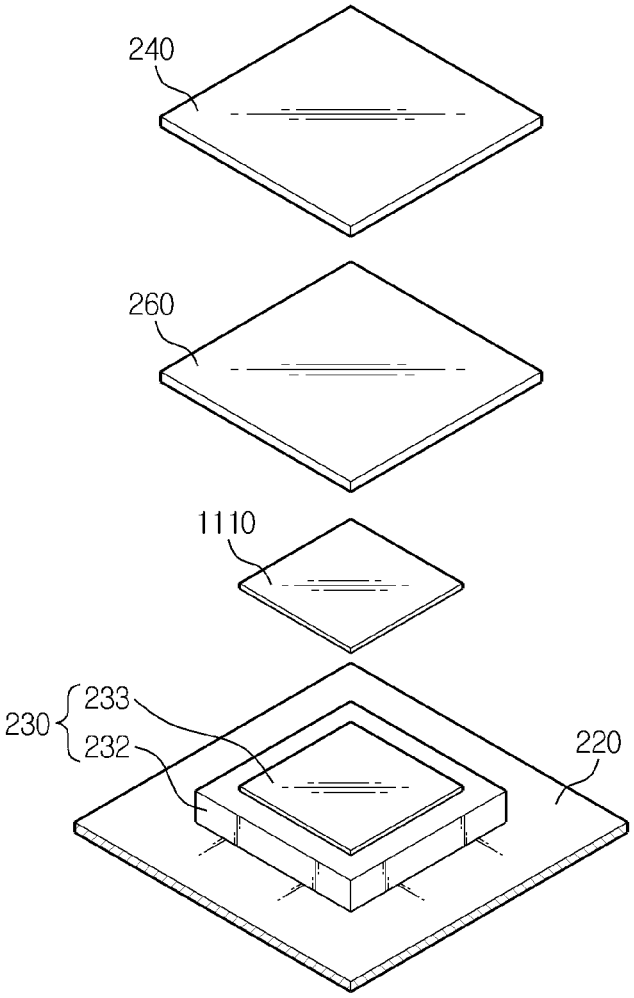
FIG. 11 is a perspective view showing main components of a vehicular antenna according to another embodiment of the present disclosure.
Figure 12:
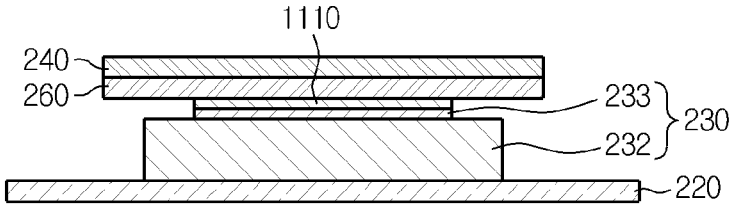
FIG. 12 is a cross-sectioned view showing that main components of FIG. 11 are laminated.

FIG. 11 is a perspective view showing main components of the vehicular antenna according to another embodiment of the present disclosure, and FIG. 12 is a cross-sectioned view showing that main components of FIG. 11 are laminated. Referring to FIGS. 11 and 12, the dielectric substance 232 and the antenna patch 233 of the antenna module 230 are laminated in order on the ground surface of a signal processing board 220, and a spacer 1110 having a dielectric permittivity close to 1 such as a sponge is laminated on the antenna patch 233 of the antenna module 230. In addition, the dielectric substance 260 and the reflector 240 are laminated in order on the spacer 1110. Since the spacer 1110 has a dielectric permittivity close to that of the air, the radiation of the electromagnetic waves is not affected even though the spacer 1110 is inserted between the antenna patch 233 and the dielectric substance 260. Since components are laminated without any air gap from the ground surface of the signal processing board 220 to the reflector 240, it is not needed to support the reflector 240 with a separate supporting structure. Thus, the antenna module 230 may be integrally manufactured together with the reflector 240, and the antenna module 230 integrally formed with the reflector 240 may be simply mounted to the signal processing board 220 when the vehicular antenna is assembled, thereby simplifying the manufacturing process and reducing the defect rate. In addition, the spacer 1110 is a sponge-like material that is capable of absorbing the impact while the vehicle is moving, thereby enabling stable operation of the vehicular antenna.

The present disclosure has been described in detail. However, it should be understood that the detailed description and specific examples, while indicating preferred embodiments of the disclosure, are given by way of illustration only, since various changes and modifications within the scope of the disclosure will become apparent to those skilled in the art from this detailed description.

What is claimed is:

1. A vehicular antenna, comprising:

an antenna module having an antenna patch;

a reflector installed to be spaced apart from the antenna patch by a predetermined distance to maximize a gain of an electromagnetic wave radiated from the antenna patch at a specific angle; and a first dielectric substance inserted and installed between the antenna patch and the reflector, wherein the antenna module includes:

a ground surface:

a second dielectric substance laminated on the ground surface;

and the antenna patch laminated on the second dielectric substance;

wherein an upper surface of the reflector has a fractal structure.

2. The vehicular antenna according to claim 1, wherein the first dielectric substance is installed in contact with the reflector and spaced apart from the antenna patch by a predetermined distance.

3. The vehicular antenna according to claim 2, further comprising:

a spacer installed in a space between the antenna patch and the first dielectric substance to be in contact with the antenna patch and the first dielectric substance.

4. The vehicular antenna according to claim 3, wherein the spacer is a sponge.

5. The vehicular antenna according to claim 1, wherein the first dielectric substance has a dielectric permittivity of 3 to 50.

6. The vehicular antenna according to claim 5, wherein the dielectric permittivity of the first dielectric substance is 12.

7. The vehicular antenna according to claim 6, wherein the first dielectric substance and the reflector have a size identical to or greater than the antenna patch.

8. The vehicular antenna according to claim 6, wherein the first dielectric substance has a greater thickness than the reflector.

9. The vehicular antenna according to claim 6, wherein a distance between the first dielectric substance and the antenna patch is 0.1 mm.

10. The vehicular antenna according to claim 6, wherein a distance between the reflector and the antenna patch is 1.2 mm.

* * * * *